US007583912B2

(12) United States Patent
Saito et al.

(10) Patent No.: US 7,583,912 B2
(45) Date of Patent: Sep. 1, 2009

(54) IMAGE FORMING APPARATUS AND IMAGE FORMING APPARATUS MANUFACTURING METHOD

(75) Inventors: Manabu Saito, Saitama (JP); Akira Ishiguchi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 137 days.

(21) Appl. No.: 11/694,831

(22) Filed: Mar. 30, 2007

(65) Prior Publication Data

US 2007/0242974 A1 Oct. 18, 2007

(30) Foreign Application Priority Data

Apr. 14, 2006 (JP) ..... 2006-112184

(51) Int. Cl.
*G03G 15/00* (2006.01)

(52) U.S. Cl. ..... 399/107; 399/109

(58) Field of Classification Search ..... 399/107, 399/109, 108, 110
See application file for complete search history.

(56) References Cited

U.S. PATENT DOCUMENTS 6,678,487 B2 * 1/2004 Tashiro et al. ..... 399/107
6,928,251 B2 * 8/2005 Yoshihara et al. ..... 399/107
2005/0069340 A1 * 3/2005 Noda et al. ..... 399/107
2006/0180994 A1 8/2006 Jang et al.

FOREIGN PATENT DOCUMENTS

| | | | |
|---|---|---|---|
| JP | 2001-071584 | A | 3/2001 |
| JP | 2002-303337 | A | 10/2002 |
| JP | 2004-177602 | A | 6/2004 |
| KR | 2000-0031620 | A | 6/2000 |
| KR | 10-0565084 | B1 | 3/2006 |

* cited by examiner

*Primary Examiner*—David M Gray
*Assistant Examiner*—Billy J Lactaoen
(74) *Attorney, Agent, or Firm*—Sughrue Mion, PLLC

(57) ABSTRACT

An image forming apparatus includes: a pair of opposing covers; a recording part that forms an image on a sheet; a feed roller that feeds the sheet to the recording part; and a discharge roller that discharges the sheet on which the image is formed by the recording part. The recording part and at least one roller of the feed roller and the discharge roller are supported with the pair of the opposing covers.

6 Claims, 7 Drawing Sheets

IMAGE FORMING APPARATUS AND IMAGE FORMING APPARATUS MANUFACTURING METHOD

CROSS-REFERENCE TO RELATED APPLICATIONS

This application is based on and claims priority under 35 USC 119 from Japanese Patent Application No. 2006-112184 filed Apr. 14, 2006.

BACKGROUND

The present invention relates to an image forming apparatus such as a copier, a facsimile machine or a printer, and an image forming apparatus manufacturing method.

TECHNICAL FIELD

Related Art

There is disclosed this type of image forming apparatus having a support member (frame) supporting an image forming unit, plural rollers, motors and the like inside an image forming apparatus main body.

However, in the conventional techniques, the image forming unit, the plural rollers and motors are supported with the frame, and an exterior cover is attached to the frame. Accordingly, downsizing of the image forming apparatus and cost reduction cannot be attained without difficulty.

SUMMARY

The present invention has been made so as to address the above problem, and provides and image forming apparatus in which downsizing and cost reduction are attainable and a manufacturing method of the image forming apparatus.

According to an aspect of the invention, an image forming apparatus includes: a pair of opposing covers; a recording part that forms an image on a sheet; a feed roller that feeds the sheet to the recording part; and a discharge roller that discharges the sheet on which the image is formed by the recording part, the recording part and at least one roller of the feed roller and the discharge roller being supported with the pair of the opposition covers.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described based on the drawings.

Figure 1:
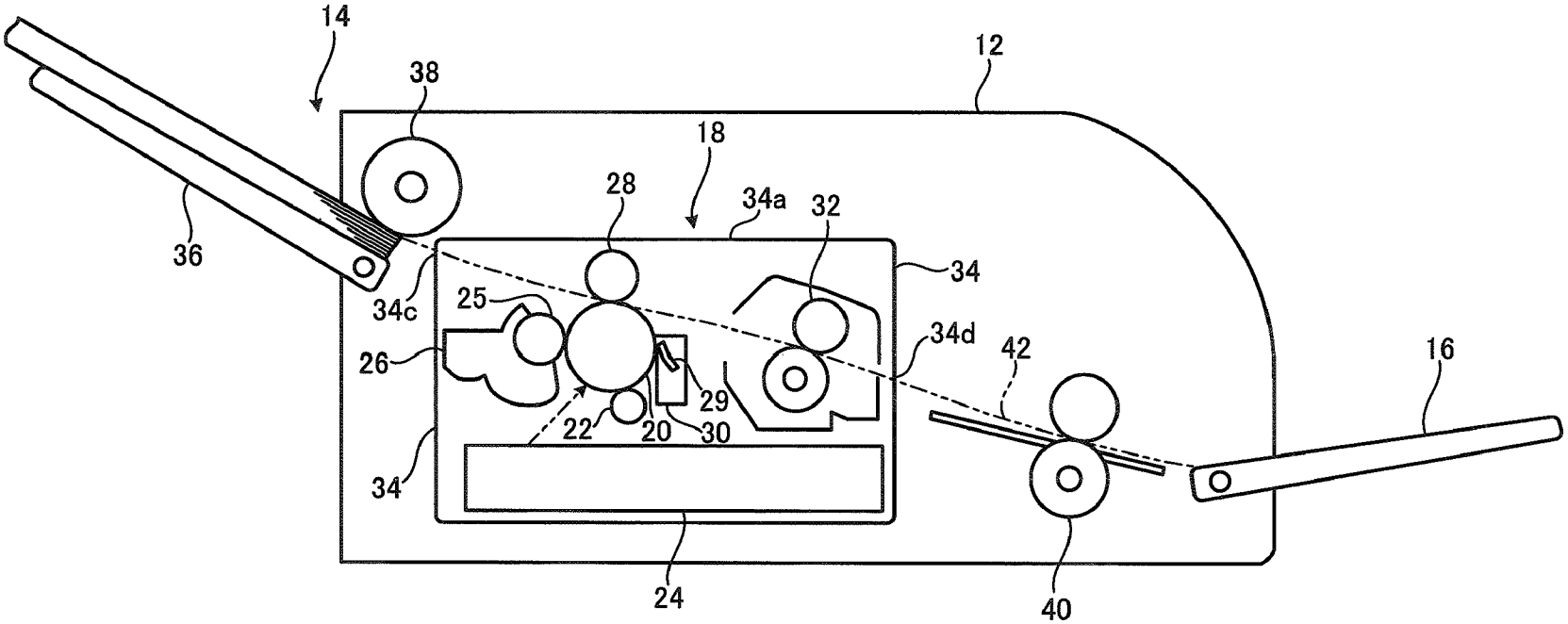
FIG. 1 is a cross-sectional view schematically showing the structure of an image forming apparatus according to a first exemplary embodiment of the present invention.
Figure 2:
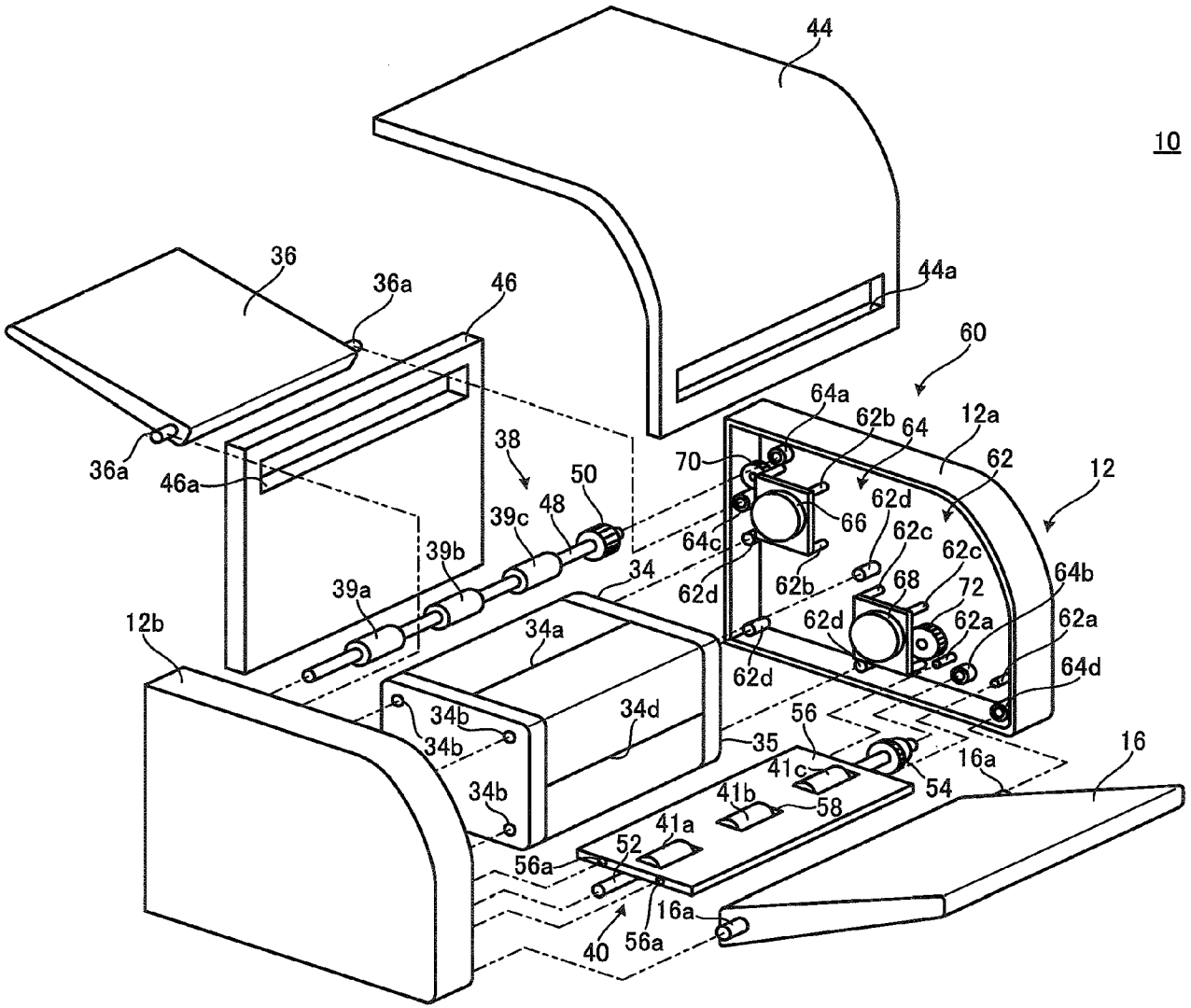
FIG. 2 is an exploded perspective view showing the structure of the image forming apparatus according to the first exemplary embodiment of the present invention.

FIG. 1 schematically shows the structure of an image forming apparatus 10 according to a first exemplary embodiment of the present invention. The image forming apparatus 10 has covers 12. A sheet feeder 14 is provided at its one end (left end in FIG. 1) of the covers 12, and a discharge tray 16 is provided at the other end (right end in FIG. 1) of the covers 12. Further, an image forming unit 18 is installed in the covers 12.

The image forming unit 18 is an electrophotographic type unit. The image forming unit 18 has a cylindrical photoreceptor 20 used as an image holder, a charger 22 that uniformly charges the photoreceptor 20, a light writer 24 that optically writes a latent image on the photoreceptor 20 charged with the charger 22, a developing device 26 having a developing roller 25 to visualize the latent image on the photoreceptor 20 formed with the light writer 24 using developing material, a transfer device 28 having e.g. a transfer roller that transfers the developing material image visualized with the developing device 26 onto a sheet, a cleaner 30 having a cleaning blade 29 to remove developing material remaining on the photoreceptor 20, and a fixing device 32 that fixes the developing material image on the sheet, transferred with the transfer device 28, to the sheet. The light writer 24 has e.g. a scan type laser exposure device, however, an LED, a surface emission type laser or the like may be employed as the light writer 24.

The constituent elements of the image forming unit 18, i.e., the photoreceptor 20, the charger 22, the light writer 24, the developing device 26, the transfer device 28, the cleaner 30 and the fixing device 32, are integrated as a recording part 34, and accurately positioned with each other. Note that as the temperature of the fixing device 32 becomes high, the fixing device 32 may be provided outside the recording part 34. Further, an upper surface 34*a* of the recording part 34 is openable. Upon occurrence of paper jam, the upper surface 34*a* is opened, thereby a jammed sheet can be removed. Further, a user can open the upper surface 34*a* of the recording part 34 and exchange each respective functional element (e.g., the developing device 26) with a new one.

The sheet feeder 14, having a feed tray 36 used as a sheet container and a feed roller 38 to convey a top sheet contained in the feed tray 36, feeds sheets stacked on the feed tray 36 to the above-described recording part 34.

A sheet supply path 42 is provided approximately horizontally around a central portion of the image forming apparatus 10. The feed roller 38, the recording part 34 and discharge roller 40 to discharge a sheet where an image is formed, are provided on the sheet supply path 42.

In the image forming apparatus 10 having the above structure, the photoreceptor 20 is uniformly charged with the charger 22, and light from the light writer 24 based on an image signal is emitted on the charged photoreceptor 20 and a latent image is formed on the photoreceptor 20. The latent image is developed with the developing device 26 using developing material and a developing material image is formed. On the other hand, a sheet contained in the feed tray 36 is fed with the feed roller 38, and guided to a position between the transfer device 28 and the photoreceptor 20. When the sheet has been guided to the position between the transfer device 28 and the photoreceptor 20, the developing material image on the photoreceptor 20 is transferred with the transfer device 28 onto the sheet. The sheet holding the transferred developing material image is passed through the fixing device 32 and discharged with the discharge roller 40 onto the discharge tray 16. Accordingly, the sheets on the feed tray 36 are sequentially sent through an I-shaped (straight) path to the discharge tray 16.

Next, the detailed structure of the image forming apparatus 10 will be described based on FIGS. 2, 3 and FIGS. 4A and 4B.

The image forming apparatus 10 has a pair of opposing covers 12*a* and 12*b*, an upper cover 44 and a rear surface cover 46.

The upper cover 44 having a rounded L-shaped corner is provided so as to cover an upper surface and a front surface (right end portion in FIG. 1) of the image forming apparatus 10. A sheet discharge port 44*a* is provided at a right end of the upper cover 44. The rear surface cover 46 having a plate shape is provided on a rear surface (left end portion in FIG. 1) of the image forming apparatus 10. A sheet supply port 46*a* is provided around an upper end of the rear surface cover 46.

The feed roller 38 has a first rotation shaft 48 to support a first roller 39*a*, a second roller 39*b* and a third roller 39*c*. A supply gear 50 is fixed to one end of the first rotation shaft 48. The feed roller 38 is provided around the sheet supply port 46*a*. The discharge roller 40 has a second rotation shaft 52 to support a first roller 41*a*, a second roller 41*b* and a third roller 41*c*. A discharge gear 54 is fixed to one end of the second rotation shaft 52. The discharge roller 40 is provided around the sheet discharge port 44*a*. Further, a plate-shaped sheet guide 56 to guide a sheet being conveyed is provided above the second rotation shaft 52. The sheet guide 56 has three through holes 58. The through holes 58 are formed in positions corresponding to the first roller 41*a*, the second roller 41*b* and the third roller 41*c* of the discharge roller 40, and the first roller 41*a*, the second roller 41*b* and the third roller 41*c* are projected from an upper surface of the sheet guide 56.

The recording part 34 has a metal chassis 35. The above-described photoreceptor 20, the charger 22, the light writer 24, the developing device 26, the transfer device 28, the cleaner 30 and the fixing device 32 are supported with the chassis 35. In this manner, as the respective constituent elements of the image forming unit 18 are supported with the chassis 35 of the recording part 34, the positional accuracy of the respective constituent elements, which needs to be high, can be maintained. Respectively four engagement holes 34*b* are formed in both side surfaces of the recording part 34, and engaged with recording unit support studs 62*d* of the first cover 12*a* and the second cover 12*b* to be described later. Further, a sheet supply port 34*c* (shown in FIG. 1) is formed in a rear surface of the recording part 34 (left side surface in FIG. 2), and a sheet discharge port 34*d* (shown in FIGS. 1 and 2) is formed in a front surface of the recording part 34 (right side surface in FIG. 2). Accordingly, a sheet fed into the recording part 34 via the sheet supply port 34*c* is discharged via the sheet discharge port 34*d* to the outside of the recording part 34. As driving necessary for the recording part 34, a driving unit may be provided inside the recording part 34, or the driving may be transmitted from a first or second motor to be described later.

The cover 12, which is made of e.g. resin, has a first cover 12*a* and a second cover 12*b*. The first cover 12*a* and the second cover 12*b* are provided in a pair in opposing positions. Further, a support member 60 as a support unit is integrally formed with the cover 12 on an inner wall surface of the cover 12. The support member 60 has plural column-shaped studs 62 and plural cylindrical-shaped bearings 64 projected toward inside of the covers 12.

Figure 3:
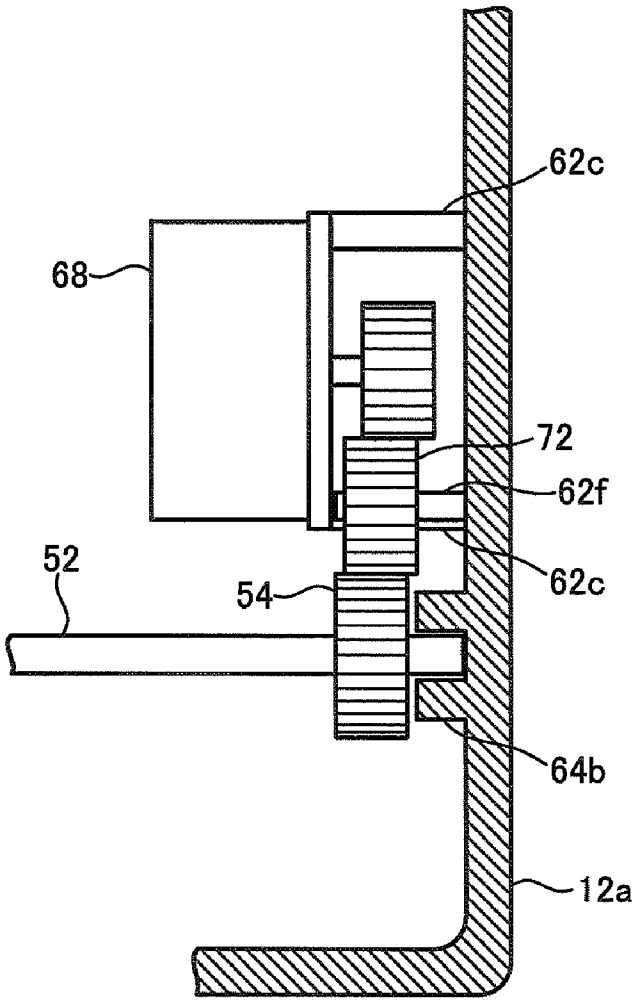
FIG. 3 is a partial cut-away cross-sectional view showing the structure of a cover in the image forming apparatus according to the first exemplary embodiment of the present invention.

The studs 62 include guide support studs 62*a*, first motor support studs 62*b*, second motor support studs 62*c*, recording unit support studs 62*d*, a first intermediate gear stud 62*e* (not shown) and a second intermediate gear stud 62*f* (shown in FIG. 3). Further, the bearings 64 include feed roller bearings 64*a*, discharge roller bearings 64*b*, feed tray bearings 64*c* and discharge tray bearings 64*d*. In the present exemplary embodiment, the bearings 64 are integrally formed with the cover 12, however, ball bearings or the like may be fixed to the cover.

The guide support studs 62*a* are provided in respectively two positions on the first cover 12*a* and the second cover 12*b*. The guide support studs 62*a* are engaged with respectively two engagement holes 56*a* formed in the both side surfaces of the sheet guide 56, to support the sheet guide 56. The first motor support studs 62*d* are provided in e.g. four positions on the first cover 12*a* to support the first motor 66 as a driving unit to drive the feed roller 38. Further, the second motor support studs 62*c* are provided in e.g. four positions on the first cover 12*a* to support the second motor 68 as a driving unit to drive the discharge roller 40.

The recording unit support studs 62*d* are provided in respectively four positions on the first cover 12*a* and the second cover 12*b*. The recording unit support studs 62*d* are engaged with respectively four engagement holes 34*b* formed in the both side surfaces of the recording part 34, to support the recording part 34. The first intermediate gear stud 62*e* (not shown) is provided on the first cover 12*a* to rotatably support a first intermediate gear 70 to be described later. Further, as also shown in FIG. 3, the second intermediate gear stud 62*f* is provided on the first cover 12*a* to rotatably support a second intermediate gear 72 to be described later.

The feed roller bearings 64*a* are provided in respectively one position on the first cover 12*a* and the second cover 12*b*. The feed roller bearings 64*a* are rotatably engaged with both ends of the first rotation shaft 48, to support the feed roller 38. The discharge roller bearings 64*b* are provided in respectively one position on the first cover 12*a* and the second cover 12*b*. The discharge roller bearings 64*b* are rotatably engaged with both ends of the second rotation shaft 52, to support the discharge roller 40.

The feed tray bearings 64*c* are provided in respectively one position on the first cover 12*a* and the second cover 12*b*. The feed tray bearings 64*c* are rotatably engaged with a support shaft 36*a* formed on both side surfaces of the feed tray 36, to support the feed tray 36. The discharge tray bearings 64*d* are provided in respectively one position on the first cover 12*a* and the second cover 12*b*. The discharge tray bearings 64*d* are rotatably engaged with a support shaft 16*a* formed on both side surfaces of the discharge tray 16, to support the discharge tray 16.

The first intermediate gear 70 is provided on the first cover 12*a* to be connected to the first motor 66 and the supply gear 50. Further, as also shown in FIG. 3, the second intermediate gear 72 is provided on the first cover 12*a* to be connected to the second motor 68 and the discharge gear 54.

Further, a control board (not shown) to control a power source, motors and the like is attached on an inner wall of the second cover 12*b*.

In this manner, in the image forming apparatus 10 of the present invention, the recording part 34, the feed roller 38 and the discharge roller 40 are supported with the pair of opposing covers 12*a* and 12*b*.

Figure 4B:
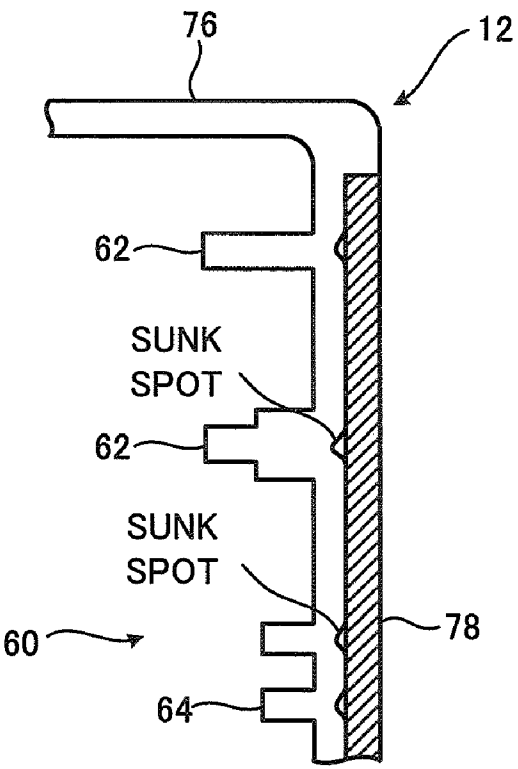
FIG. 4B is a cross-sectional view showing the structure of the cover formed with two layers in the image forming apparatus according to the first exemplary embodiment of the present invention.
Figure 4A:
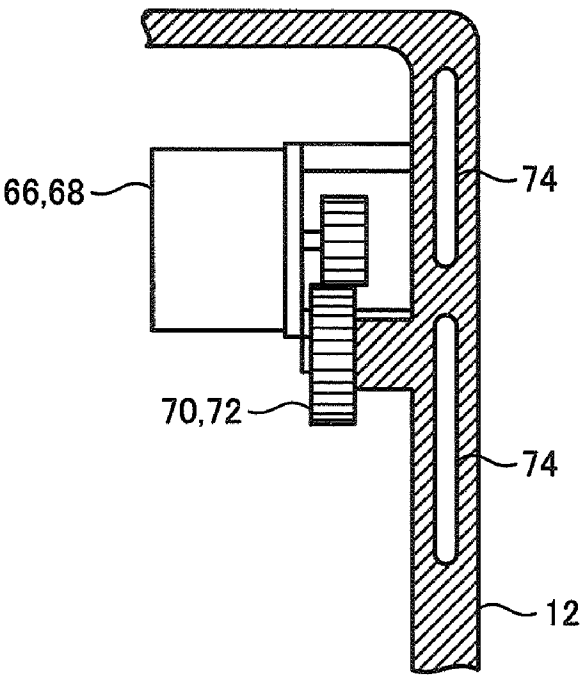
FIG. 4A is a partial cut-away cross-sectional view showing the structure of the cover including hollows in the image forming apparatus according to the first exemplary embodiment of the present invention.

As shown in FIG. 4A, plural hollows 74 are formed inside the covers 12*a* and 12*b*. The hollows 74 are formed by blow molding, gas injection or the like, around vibration sources such as the first motor 66, the second motor 68, the first intermediate gear 70 and the second intermediate gear 72.

In this manner, as the hollows 74 are provided inside the covers 12*a* and 12*b*, the cross-sectional area of the covers 12*a* and 12*b* is increased, and the rigidity of the covers 12*a* and 12*b* can be improved. Further, as the hollows 74 are provided inside the covers 12*a* and 12*b*, noise and vibration transmitted from the vibration sources can be suppressed.

Note that it may be arranged such that the covers 12*a* and 12*b* have double-layer structure and vibration isolating material or the like is provided between an inner member and an outer member.

Further, as shown in FIG. 4B, the covers 12*a* and 12*b* are formed with two layers, a side surface cover main body 76 as an inner member and a decorative cover 78 as an outer member. The above-described support member 60 having the studs 62 and the bearings 64 is formed on the side surface main body 76, and the decorative cover 78 is provided on the outside of the side surface cover main body 76.

In this manner, the covers 12*a* and 12*b* have a double-layer structure including the side surface cover main body 76 and the decorative cover 78. Even if a sunk spot occurred upon formation of the side surface cover main body 76, the sunk spot portion can be hidden from the user's eyes.

Note that the "sunk spot" means a dent formed upon injection molding of resin. When the heated resin is cooled and hardened, the volume becomes short due to contraction of the resin, and a dent is formed in a finally hardened portion.

Next, an image forming apparatus 100 in a comparative example, compared with the image forming apparatus 10 of the present invention, will be described based on FIG. 7.

Figure 7:
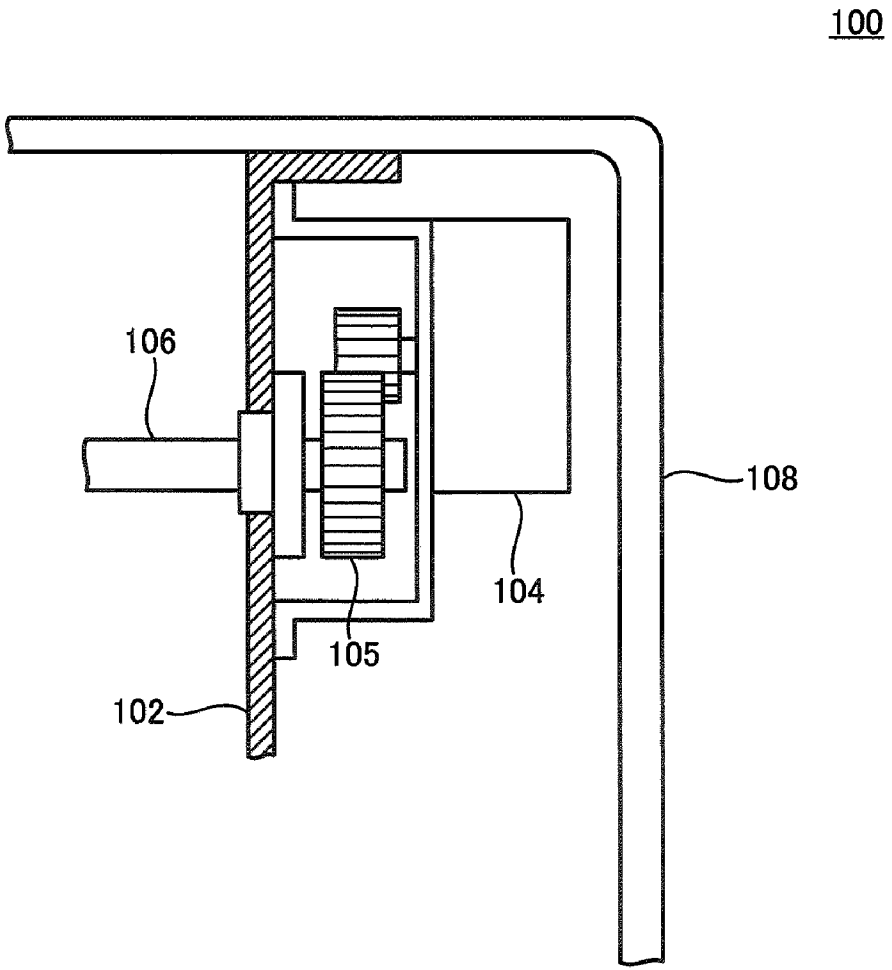
FIG. 7 is a partial cut-away cross-sectional view of an image forming apparatus in a comparative example.

As shown in FIG. 7, the image forming apparatus 100 of this comparative example has a pair of opposing side frames 102. A rotation shaft 106, to which a motor 104 and a gear 105 are fixed, a recording unit (not shown) and the like are supported with the side frames 102. Further, a cover 108 is attached to the outside of the side frames 102.

In comparison with the image forming apparatus 100 of the comparative example, in the image forming apparatus 10 of the present invention, the recording part 34, the feed roller 38, the discharge roller 40 and the like are supported with the pair of covers 12*a* and 12*b*. Accordingly, the side frames in the comparative example can be omitted, thus downsizing of the image forming apparatus 10 in a widthwise direction and cost reduction can be attained.

Figure 5:
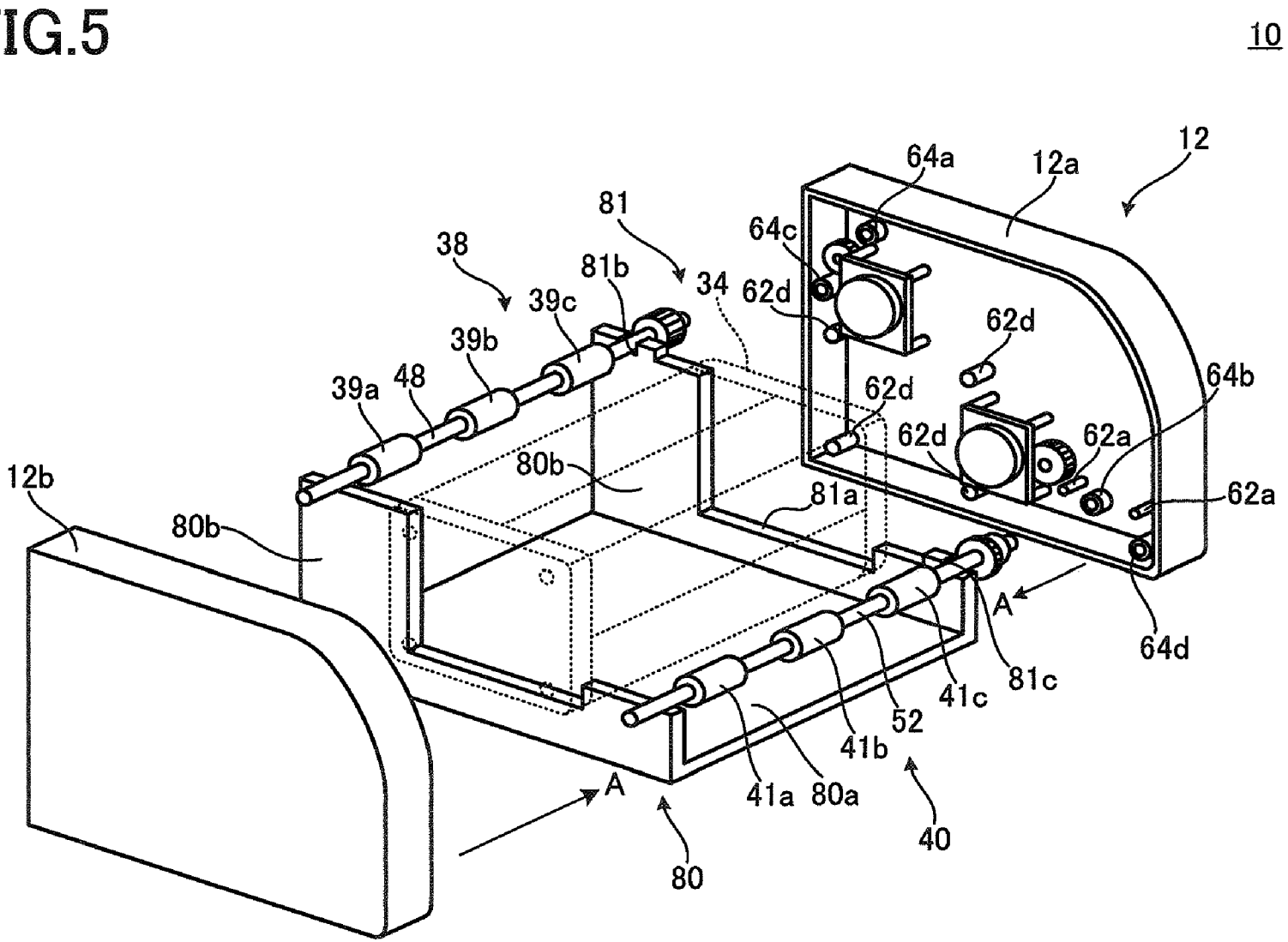
FIG. 5 is an exploded perspective view showing a manufacturing method of the image forming apparatus according to the first exemplary embodiment of the present invention.

Next, a manufacturing method of the image forming apparatus 10 will be described based on FIG. 5.

An assembly jig 80 has a bottom plate 80*a* and two side plates 80*b* provided upright in a vertical direction from the bottom plate 80*a*. The side plates 80*b* have, e.g. three step members 81 in predetermined positions.

As a first process of manufacture of the image forming apparatus 10, the recording part 34 is placed to be engaged with the first step member 81*a* of the assembly jig 80, then the feed roller 38 is placed to be engaged with the second step member 81*b* of the assembly jig 80, and the discharge roller 40 is placed to be engaged with the third step member 81*c* of the assembly jig 80. Thus the recording part 34, the feed roller 38 and the discharge roller 40 are positioned with respect to the assembly jig 80.

As a second process, the first cover 12*a* and the second cover 12*b* are attached from the both sides of the recording part 34, the feed roller 38 and the discharge roller 40 positioned with respect to the assembly jig 80. That is, the first cover 12*a* and the second cover 12*b* are moved in an arrow A direction in FIG. 5, then the engagement holes 34*b* of the recording part 34 are engaged with the recording part support studs 62*d*, the first rotation shaft 48 is engaged with the feed roller bearings 64*a*, and the second rotation shaft 52 is engaged with the discharge roller bearings 64*b*.

As a third process, the sheet guide 56, the feed tray 36 and the discharge tray 16 (shown in FIG. 2) are engaged with the guide support studs 62*a*, the feed tray bearings 64*c* and the discharge tray bearings 64*d*. Then the upper cover 44 and the rear surface cover 46 (shown in FIG. 2) are fixed to the first cover 12*a* and the second cover 12*b*. Next, the assembly jig 80 is removed from the image forming apparatus 10.

Note that the sheet guide 56, the feed tray 36, the discharge tray 16, the upper cover 44 and the rear surface cover 46 may be held with the assembly jig 80.

In this manner, by use of the assembly jig 80, the respective parts including the recording part 34, the feed roller 38 and the discharge roller 40 are positioned with respect to the assembly jig 80. Accordingly, the manufacture of the image forming apparatus 10 can be facilitated.

Note that in the present exemplary embodiment, the respective functional elements of the recording part 34 are integrated, however, it may be arranged such that the respective functional elements, as units, are directly supported with the covers 12*a* and 12*b*.

Figure 6:
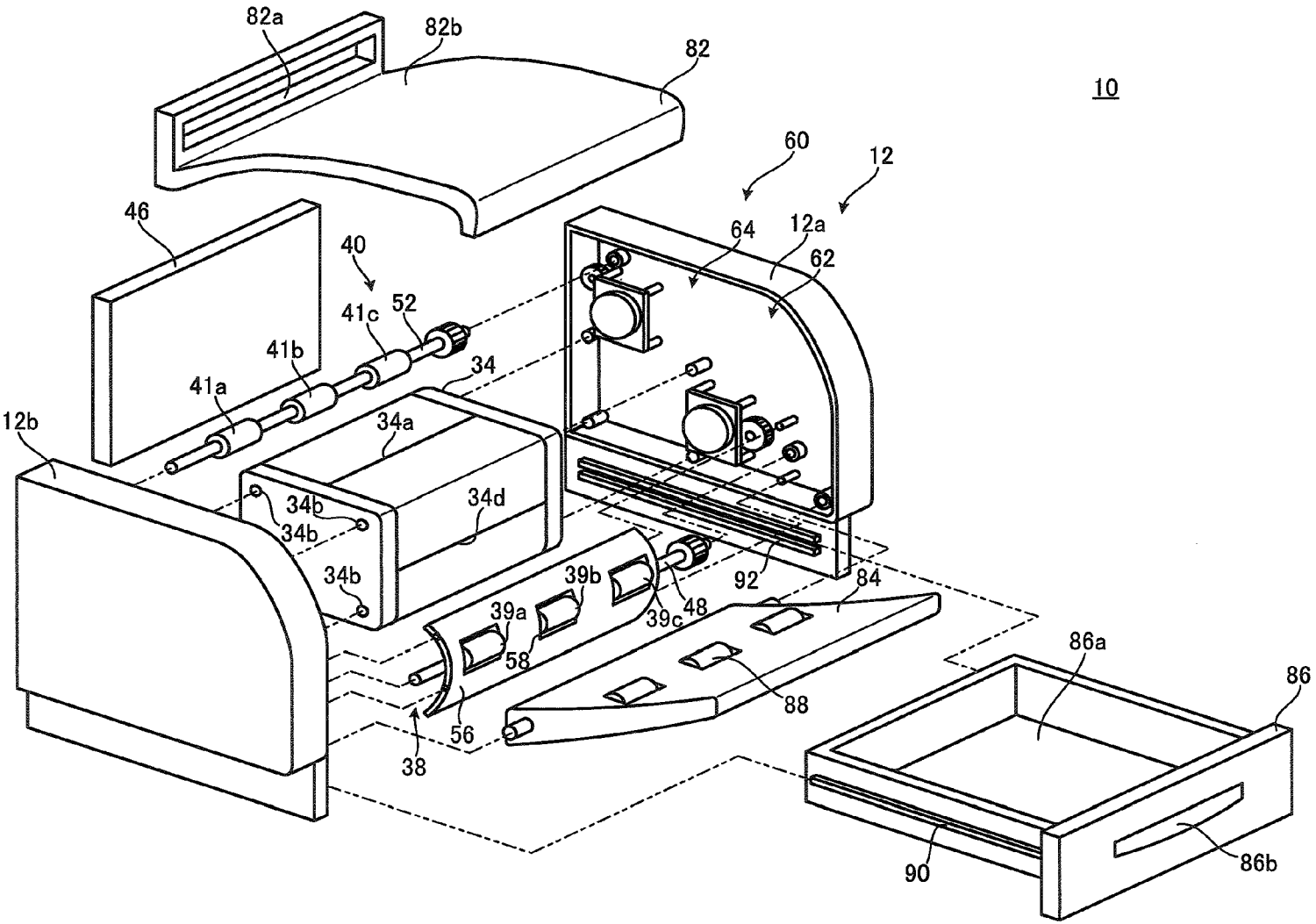
FIG. 6 is an exploded perspective view showing a manufacturing method of the image forming apparatus according to a second exemplary embodiment of the present invention.

Next, a second exemplary embodiment of the present invention will be described based on FIG. 6.

The image forming apparatus 10 of the present exemplary embodiment has the pair of opposing covers 12*a* and 12*b*, an upper surface cover 82, a front surface cover 84 and the rear surface cover 46. Further, a sheet cassette 86 is removably provided at a lower end of the covers 12*a* and 12*b*.

The upper surface cover 82 is provided at an upper end of the image forming apparatus 10, and is provided with a sheet discharge port 82*a* and a sheet discharge part 82*b*. The front surface cover 84 is provided on the front surface (right end in FIG. 6) of the image forming apparatus 10, and plural conveyance rollers 88 are provided on the inner wall surface of the front surface cover 84. The sheet cassette 86 has a sheet container 86*a* on which plural sheets are stacked, and has a grip member 86*b* on its front surface (right end in FIG. 6). Further, a convex member 90 is provided on both side surfaces of the sheet cassette 86 such that the convex members 90 are slidably engaged with rails 92 provided around the lower end of the pair of covers 12*a* and 12*b*.

In this manner, in the image forming apparatus 10 of the present exemplary embodiment, the sheet cassette 86 is supported with the pair of opposing covers 12*a* and 12*b*.

Further, the feed roller 38, having the first rotation shaft 48 to support the first roller 39*a*, the second roller 39*b* and the third roller 39*c*, is provided in a position corresponding to the conveyance rollers 88 on the front surface cover 84. Further, a sheet guide 56 with a predetermined curvature is provided around the first rotation shaft 48. The sheet guide 56 is provided with e.g., three through holes 58. The through holes 58 are formed in positions corresponding to the first roller 39*a*, the second roller 39*b* and the third roller 39*c*, and the first roller 39*a*, the second roller 39*b* and the third roller 39*c* are projected from the surface of the sheet guide 56. The discharge roller 40, having the second rotation shaft 52 to support the first roller 41*a*, the second roller 41*b* and the third roller 41*c*, is provided around the sheet discharge port 82*a* of the upper surface cover 82.

The sheet contained in the sheet container 86*a* of the sheet cassette 86 is fed with the feed roller 38 to the recording part 34, then an image is formed with the recording part 34 on the sheet, and the sheet is discharged with the discharge roller 40 to the discharge unit 82*b*. Accordingly, the sheets in the sheet cassette 86 are sequentially passed through an S-shaped path and discharged to the discharge unit 82*b*.

Note that the sheet cassette 86 of the present exemplary embodiment may be an electrical cassette provided with a control board and the like.

As described above, the present invention is applicable to an image forming apparatus having a cover.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

a pair of opposing covers;

a recording part that forms an image on a sheet;

a feed roller that feeds the sheet to the recording part; and a discharge roller that discharges the sheet on which the image is formed by the recording part, the recording part and at least one roller of the feed roller and the discharge roller being supported directly with the pair of the opposing covers.

2. The image forming apparatus according to claim 1, further comprising a support unit that supports the recording part and at least one roller of the feed roller and the discharge roller, wherein the support unit is integrally formed with the pair of the opposing covers.

3. The image forming apparatus according to claim 1, further comprising a driving unit that drives at least one roller of the feed roller and the discharge roller, wherein the driving unit is supported with the pair of the opposing covers.

4. The image forming apparatus according to claim 3, wherein the covers are formed with at least two layers having an outer member and an inner member, and the support unit is formed on the inner member.

5. The image forming apparatus according to any one of claims 1 to 4, wherein a hollow is formed inside the pair of the opposing covers.

6. An image forming apparatus manufacturing method for manufacturing an image forming apparatus comprising a recording part that forms an image on a sheet, a feed roller that feeds the sheet to the recording part, and a discharge roller that discharges the sheet on which the image is formed by the recording part, the method comprising:

performing positioning on the recording part and at least one roller of the feed roller and the discharge roller with respect to a jig;

attaching the recording part and at least one of the feed roller and the discharge roller, positioned with respect to the jig at the positioning step, to a pair of opposing covers such that the recording part and at least one of the feed roller and the discharge roller are supported directly with the opposing covers; and removing the jig from the covers and the recording part and the at least one roller attached to the cover at the attaching step.

* * * * *